US005097812A

United States Patent [19]

Augustin

[11] Patent Number: 5,097,812

[45] Date of Patent: Mar. 24, 1992

[54] SLOPING-EDGE-CONTROLLED FUEL INJECTION PUMP FOR INTERNAL COMBUSTION-ENGINE

[75] Inventor: Ulrich Augustin, Kernen, Fed. Rep. of Germany

[73] Assignee: Daimler-Benz AG, Fed. Rep. of Germany

[21] Appl. No.: 551,308

[22] Filed: Jul. 12, 1990

[30] Foreign Application Priority Data

Jul. 14, 1989 [DE] Fed. Rep. of Germany ..... 3923306

[51] Int. Cl.[5] ..... F02M 37/04

[52] U.S. Cl. ..... 123/500; 123/300; 417/494

[58] Field of Search ..... 123/500, 501, 503, 495, 123/299, 300; 417/490, 494, 499, 501, 510, 289

[56] References Cited

U.S. PATENT DOCUMENTS

| | | | |
|---|---|---|---|
| 2,565,681 | 8/1951 | Fleck | 123/501 |
| 4,367,706 | 1/1983 | Scheying | 123/300 |
| 4,445,828 | 5/1984 | Sontheimer . | |
| 4,448,167 | 5/1984 | Schmid | 123/503 |
| 4,619,233 | 10/1986 | Yamaguchi | 123/500 |
| 4,630,586 | 12/1986 | Gontert | 132/500 |
| 4,674,461 | 6/1987 | Hiyama | 123/500 |
| 4,830,587 | 5/1989 | Guntert | 123/500 |
| 4,881,506 | 11/1989 | Hoecker | 123/500 |

FOREIGN PATENT DOCUMENTS

| | | |
|---|---|---|
| 2607554 | 6/1988 | France . |
| 54634 | 2/1974 | Switzerland . |
| 893621 | 4/1962 | United Kingdom . |

*Primary Examiner*—Carl Stuart Miller

*Attorney, Agent, or Firm*—Evenson, Wands, Edwards, Lenahan & McKeown

[57] ABSTRACT

The invention relates to a sloping-edge-controlled fuel injection pump for internal combustion engines, in particular as a direct injector for commercial vehicles. A cam-operated pump plunger, defining the pump working chamber and having an upper control edge effecting the start of delivery and a lower sloping control edge effecting the end of delivery, is guided axially and in a rotationally movable manner in the pump cylinder and has two peripheral grooves which, with two bypasses in the pump cylinder, interrupt the delivery, each bypass, in the projection perpendicular to the axis of the pump cylinder, partly overlapping feed bores arranged in the pump cylinder.

8 Claims, 2 Drawing Sheets

SLOPING-EDGE-CONTROLLED FUEL INJECTION PUMP FOR INTERNAL COMBUSTION-ENGINE

BACKGROUND AND SUMMARY OF THE INVENTION

The invention relates to a sloping-edge-controlled injection pump for internal combustion engines. Such a pump is usable as a direct injector for commercial vehicles and the like. Injection pumps of this kind have been contemplated which comprise two feed bores, lying at the same level and diametrically opposite, in the pump cylinder, in which a cam-operated pump plunger, defining the pump working chamber and having an upper control edge effecting the start of delivery and a lower sloping control edge effecting the end of delivery, is guided axially and in a rotationally movable manner, and furthermore grooves are provided for effecting the interruption in delivery, including a peripheral groove in the pump plunger and a by-pass groove in the pump cylinder.

It is known that activities worldwide are directed towards reducing the emissions from commercial vehicles. Increasing demands with regard to greater efficiency and low pollution as well as noise thresholds must be met. To considerably reduce the combustion noises, preinjection systems in particular are suitable in order to control the release of heat in the compression-ignition engine in such a way that a combustion-chamber pressure pattern favorable with regard to the stimulation of noise develops. Complicated combustion processes with two injection pumps and two separate injection nozzles have been discontinued in view of the immense costs.

GB Patent Specification 893, 621 discloses simplified embodiments of sloping-edge-controlled fuel injection pumps which, through a certain groove and hole geometry in the pump cylinder and in the pump plunger, split up the injection into preinjection and main injection with a timed interruption in between. Due to the bores, arranged vertically offset, in the pump cylinder and due to the sloping-edge-control on one side, all the embodiments produce nonuniform flow loading of the pump plunger, which certainly occurs to a smaller extent in the embodiment according to FIG. 5 on account of the feed bores lying at the same level, but the groove geometry here leads to relatively large preinjections (size of stroke x), resulting in inadequate noise reduction.

Compared with the embodiment having preinjection and main injection disclosed by GB Patent Specification 893,621, an object of the invention, apart from a further improvement with regard to noise reduction, is also to enable more uniform loading of the pump plunger performing the stroke.

According to the invention, this object is achieved by providing a pump of the above noted type, wherein a further bypass is made in the pump cylinder and a further peripheral groove is made in the pump plunger in such a way that the two respective bypasses and peripheral grooves, as well as two stop grooves provided between the peripheral grooves and extending from the upper to the lower control edge are arranged in a rotationally symmetric manner, and wherein each bypass partly overlaps the feed bores in the projection perpendicular to the axis of the pump cylinder.

Non-uniform flow loading of the pump plunger and, as the worst consequence thereof, breakdown of the lubricating film between pump cylinder and plunger as well as the risk of a tendency to seize are avoided by the special measures according to preferred embodiments of the invention, namely to provide a rotationally symmetric groove geometry. In addition, due to the overlap (feed bores/bypasses) in the double-flow system, a relatively small preinjection quantity is obtained which has a favorable effect on the injection-quantity variation oriented to requirements and therefore on a particularly favorable noise reduction.

U.S. Pat. No. 4,445,828 discloses a fuel injection pump in which two feed bores are arranged in the pump cylinder and upper control edges and also two sloping grooves are arranged on the pump plunger for controlling the delivery, which certainly enable uniform flow loading of the pump plunger and also produce advantages relating to combustion through the increase in the flow cross-sections which results from the double-flow capacity but have an adverse effect on the combustion noises on account of the cross-sectional increase. In the embodiment according to the invention, having measures relating to control, this disadvantage does not occur during any injection operation.

Other objects, advantages and novel features of the present invention will become apparent from the following detailed description of the invention when considered in conjunction with the accompanying drawings.

DETAILED DESCRIPTION OF THE DRAWINGS

Figure 1:
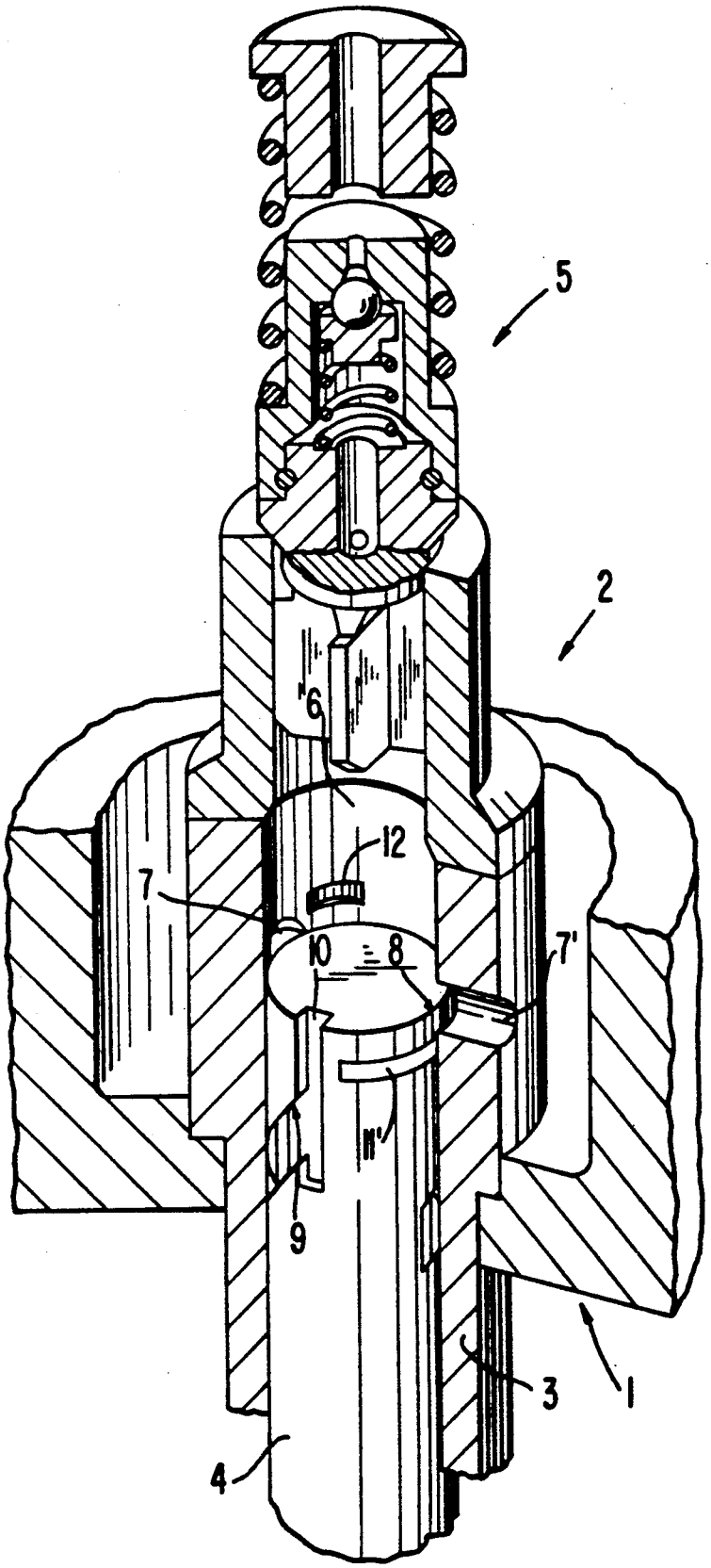
FIG. 1 shows a longitudinal section through the pump element of a sloping-edge-controlled injection pump, constructed according to a preferred embodiment of the present invention.

FIG. 1 shows a pump element 1 of a sloping-edge-controlled injection pump 2 for a compression-ignition fuel injection internal combustion engine, preferably in the embodiment as a direct injector for commercial vehicles. A pump plunger 4, guided axially and in a rotationally movable manner in the pump cylinder 3, as well as a balanced-pressure relief valve 5, define a pump working chamber 6 which, at bottom dead center of the pump plunger 4, is filled with fuel via two feed bores 7, 7' located diametrically opposite in the pump cylinder 3.

The arrangement of the balanced-pressure relief valve 5 ensure that no hollow or dead spaces arise in the injection line leading to the injection nozzle, which hollow or dead spaces impair reliable interruption of the injection and therefore hinder a satisfactory preinjection quantity of brief duration. The pump plunger 4 has an upper straight control edge 8 for initiating the injection and a lower sloping control edge 9 for ending the injection. A stop groove 10 running parallel to the axial direction of the pump plunger 4 leads from the control edge 8 down to the control edge 9. Provided next to this stop groove 10 between the two control edges 8, 9 is a peripheral groove 11 which, for the purpose of interrupting injection, connects the feed bore 7 to a groove in the pump cylinder 3, which groove acts as a bypass 12 and is formed by a ground in portion. In addition to the bypass 12, the peripheral groove 11 and the stop groove 10, a bypass 12', a peripheral groove 11' and a stop groove 10' and likewise a further lower control edge 9' are provided, in each case diametrically opposite, and in fact in a rotationally symmetric manner.

Each bypass 12, 12' has the shape of a rectangular groove with a groove width "B" of about 2.5 mm and a groove length "L" extending over an angle of about 40° (of the pump cylinder 3 circumference) as well as a maximum groove depth "TB" of about 0.8 mm.

Figure 2:
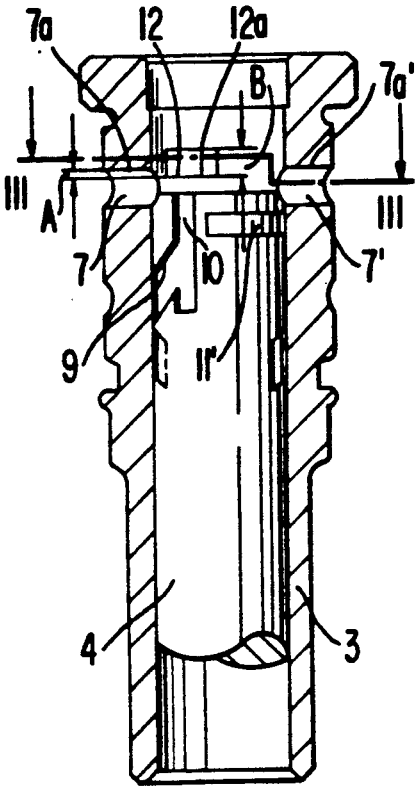
FIG. 2 shows a longitudinal section through the pump cylinder plus pump plunger of the embodiment of FIG. 1.

The groove and the feed bore 7,7', viewed in the peripheral direction, are arranged so as to lie one behind the other and be vertically offset in such a way that the bottom groove edge **12*a*, 12*a'*, in the projection perpendicular to the axis of the pump cylinder, lies in the area of the feed bore 7, 7'. The distance between the bottom groove adge 12*a*, 12' and the highest point 7*a*, 7*a'* of the feed bore 7, 7' is identified by A (FIG. 2**).

Figure 3:
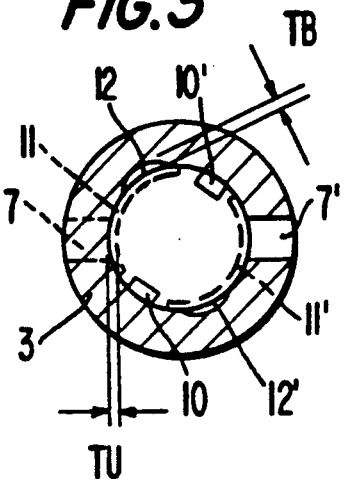
FIG. 3 shows a section through the pump cylinder along line III—III in FIG. 2.
Figure 4:
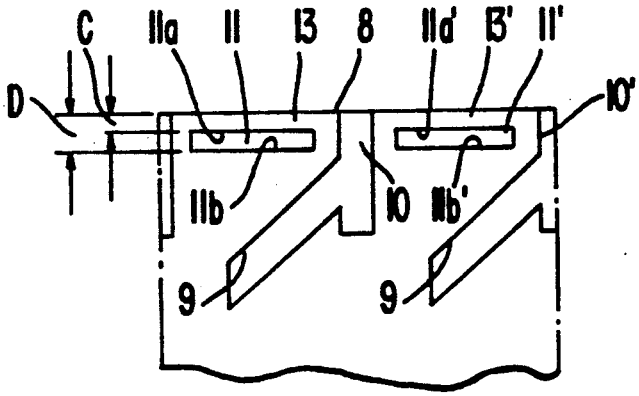
FIG. 4 shows the top part of the pump plunger of the pump of FIGS. 1-3, with peripheral grooves and stop grooves, in a planar projection.

The web 13, 13' formed by the upper control edge 8 of the pump plunger 4 and the top groove edge **11*a*, 11*a'* of the peripheral groove 11, 11' has a web width, identified by "C", of about 1.6 mm, the distance "D" between the control edge 8 and the bottom groove edge 11*b*, 11*b'* of the peripheral groove 11 being about 1.8 mm (FIG. 4). The groove depth "TU" of the peripheral groove 11, 11' is about 1.0 mm (FIG. 3**).

The web width "C" on the pump plunger 4 is not more than 0.3 mm greater than the overlap width "A", and the groove width "B" of the bypass (12, 12') in the pump cylinder 3 is about 0.8 mm greater than the web width "C" of the pump plunger 4.

The special groove geometry results in relatively small preinjection quantities, which lead to considerable improvements in the combustion noises.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Sloping-edge controlled injection pump for internal combustion engines, comprising:

a pump cylinder, a cam-operated pump plunger slidably and rotatably disposed in the pump cylinder to thereby define a pump working chamber together with the pump cylinder, first and second fuel feed bores in the pump cylinder which open to the pump working chamber at diametrically opposite sides of the pump cylinder, an upper control edge on the pump plunger for effecting start of fuel delivery and a lower sloping control edge on the pump plunger for effecting cessation of fuel delivery as the pump plunger moves axially in the pump cylinder, first and second stop grooves disposed at symmetrically arranged opposite diametric sides of the pump plunger, said stop grooves extending between the upper and lower control edges, and fuel delivery interruption groove means for effecting interruption in fuel delivery during a predetermined fuel injection interruption range of the travel path of the pump plunger in the pump cylinder, said fuel delivery interruption groove means including first and second peripheral grooves in the pump plunger and first and second bypass grooves in the pump cylinder which are disposed in rotationally symmetric locations at opposite diametric sides of the plunger, said first peripheral groove and first bypass groove together connecting to the first fuel feed bore and said second peripheral groove and second bypass groove together connecting to the second fuel feed bore to thereby interrupt fuel injection in response to disposition of the plunger and cylinder in said fuel injection interruption range, each of said bypass grooves being disposed in partly axially overlap the feed bores, wherein a top portion of the peripheral grooves is separated from the upper control edge by a piston separation web having an axial web width which is greater than the axial overlap of said bypass grooves with respect to the feed bores, and wherein said axial web width is at most 0.3 mm greater than said axial overlap.

2. Fuel injection pump according to claim 1, wherein a pressure relief valve is disposed in the pump cylinder in facing relationship to the pump plunger.

3. Fuel injection pump according to claim 1, wherein each of said bypass grooves has a maximum groove depth of about 0.8 mm.

4. Fuel injection pump according to claim 1, wherein each of said bypass grooves has an axial groove width of about 2.5 mm and a circumferential groove length extending over an angle of about 40° of the internal pump cylinder circumference.

5. Fuel injection pump according to claim 1, wherein said axial web width is approximately 1.6 mm.

6. Fuel injection pump according to claim 5, wherein the distance between the upper control edge and the bottom of the peripheral groove is approximately 1.8 mm.

7. Fuel injection pump according to claim 6, wherein each of said bypass grooves has an axial groove width of about 2.5 mm and a circumferential groove length extending over an angle of about 40° of the internal pump cylinder circumference.

8. Fuel injection pump according to claim 7, wherein each of said bypass grooves has a maximum groove depth of about 0.8 mm.

* * * * *